United States Patent [19]

Böhlen et al.

[11] Patent Number: 4,917,305

[45] Date of Patent: Apr. 17, 1990

[54] SPRINKLER

[75] Inventors: Dietrich Böhlen, Puidoux; Gérard Ney, Chavornay, both of Switzerland

[73] Assignee: Nestec S.A., Vevey, Switzerland

[21] Appl. No.: 240,479

[22] Filed: Sep. 6, 1988

Related U.S. Application Data

[63] Continuation of Ser. No. 923,667, Oct. 27, 1986, abandoned.

[30] Foreign Application Priority Data

Nov. 26, 1985 [CH] Switzerland ..... 5035/85

[51] Int. Cl.[4] ..... A47G 19/24

[52] U.S. Cl. ..... 239/374; 239/553; 222/480; 222/564; 222/565

[58] Field of Search ..... 239/374, 552, 553, 567; 222/480, 547, 564, 565

[56] References Cited

U.S. PATENT DOCUMENTS

| | | | |
|---|---|---|---|
| 205,576 | 7/1878 | Robbins | 222/564 |
| 853,547 | 5/1907 | Harbeck | 222/565 |
| 1,411,594 | 4/1922 | Sweet | 222/564 |
| 1,429,590 | 9/1922 | Jones | 222/565 |
| 1,744,952 | 1/1930 | Connor | 241/84 |
| 2,222,927 | 11/1940 | Mantelet et al. | 241/169.1 |
| 2,480,606 | 8/1949 | Rabbitt | 222/480 |

FOREIGN PATENT DOCUMENTS

| | | | |
|---|---|---|---|
| 224718 | 6/1987 | European Pat. Off. | 222/564 |
| 206845 | 3/1908 | Fed. Rep. of Germany . | |
| 2275378 | 1/1976 | France . | |
| 216152 | 8/1941 | Switzerland . | |
| 1056853 | 2/1967 | United Kingdom . | |

OTHER PUBLICATIONS

P. Richter, "Shaker for Material in powder form, in Particular for Salt", German Pat. No. 206845 translation, 1908, Berlin.

Translation of Swiss Pat. No. 216152 Frick, E., "Shaker in particular for Table Salt," 1941, Switzerland.

*Primary Examiner*—Andres Kashinkow
*Assistant Examiner*—Karen B. Merritt
*Attorney, Agent, or Firm*—Vogt & O'Donnell

[57] ABSTRACT

A sprinkler for distribution of powdered and granular products has a chamber defined by a closure having holes and a plate having openings abutted by a system of flanges protruding into the interior of the container which the closure and plate surmount.

13 Claims, 2 Drawing Sheets

SPRINKLER

CROSS-REFERENCE TO RELATED APPLICATION

This is a continuation of application Ser. No. 06/923,667, filed Oct. 27, 1986, now abandoned.

BACKGROUND OF THE INVENTION

This invention relates to a sprinkler, particularly for powdered or granular products.

There are already known sprinkler systems. FR-PS No. 2 275 378 relates in particular to a sprinkler incorporating a striker system to prevent the holes in the cover from becoming blocked. This system is, on the one hand, relatively elaborate and hence onerous and, on the other hand, lends itself readily to the distribution of such products as sugar and salt, but is unsatisfactory for the distribution of granular products of high fat content.

SUMMARY OF THE INVENTION

The sprinkler according to the present invention provides for the smooth distribution of fat-containing granular products and is based on an inexpensive design.

The present invention relates to a sprinkler comprising a container for the product and a closure formed with holes comprising beneath said closure a plate having a system of openings defined by raised flanges integral with said plate. The holes are understood to be openings in the closure of which the shape and size are adapted to each specific product. By flanges, it is meant that elements have been cut into the plate, remaining integral therewith, and that these elements are then all pressed out of the plane of said plate on the container side; these elements thus form openings and allow the product to pass through said plate to the holes in the closure. The closure may, of course, be protected by a cover or any other protection system. The plate is made either of metal or of plastic.

In a first embodiment, the plate is arranged between the top of the container body and the closure, leaving approximately one centimeter gap with the plate. This plate is thus removable, may be replaced when needed and facilitates cleaning as required. It is held firmly in place by the closure and the container.

In a second embodiment, the plate is integral with the cover and separated from the holes by a distance of the order of a centimeter.

The plate assumes the shape of the container, i.e., if may be circular, square, rectangular, or oval or may assume any other geometric shape enabling it to be held by the user. Irrespective of the shape, the flanges are generally distributed uniformly, for example, in the form of a rosette, and generally assume a trapezoidal, triangular, semicircular, or semielliptical shape or any other compatible shape; they leave an area of 10 to 20% intact at the centre of the plate.

The number of flanges is not critical and they may be disposed both in the clockwise direction and in the opposite direction.

The closure is integral with the container body either by force-fitting, by screwing, or by a bayonet-type fastening.

The invention is described in more detail in the following with reference to the accompanying drawings.

BRIEF DESCRIPTION OF THE DRAWINGS

FIG. 3 is a side elevation of an embodiment having a free, removable plate arranged between the top of the container body and the closure.

DETAILED DESCRIPTION OF PREFERRED EMBODIMENTS

Figure 1:
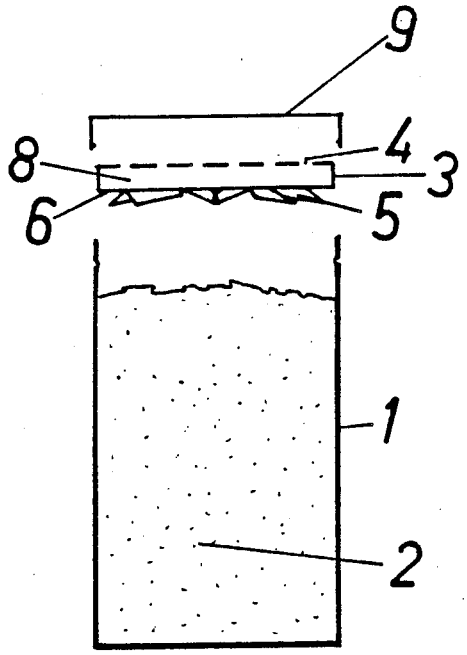
FIG. 1 is a side elevation of the sprinkler according to the aforesaid second embodiment.
Figure 2:
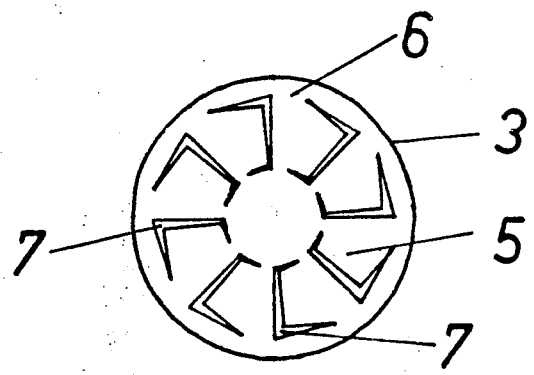
FIG. 2 is a view of the plate from beneath.

The container (1) accommodates the material (2) to be sprinkled. It is surmounted by a closure (3), having a first member which is fastened to the container body about the top open end of the container body and which extends from the top open end of the container body to a second member which has surfaces displaced from and above and in a plane parallel with a plane defined by the top open end of the container body and which has holes therethrough for dispensing the products. The top open end of the container body also is surmounted by plate (6), which is below and displaced from the closure to form chamber (8), having a system of flanges (5) abutting and defining openings (7) in the plate. These flanges are formed from a disc of a plastics material identical with that of the closure (3) and, as illustrated in FIG. 1, are integral therewith. FIG. 3 illustrates an embodiment in which the plate is not integral with the closure and is free and removable from the container and the closure. As illustrated by FIGS. 1 and 3, the flanges protrude into the interior of the container body. The cover (9) protects the product when it is not in use.

The sprinkler is used in the customary manner, i.e., the closure (3) is fastened to the container body (1) which is then turned upside down for sprinkling. The mass of product (2) does not accumulate directly against the holes (4) but instead passes through the openings (7) defined by the flanges (5) to arrive at said holes (4). The chamber (8) thus formed at the level of the distribution head provides for smooth distribution of the product and avoids blocking of the holes (4).

The invention thus provides a very effective, inexpensive and easy-to-use sprinkler which may be used for sprinkling any type of product, above all, products of high fat content, such as condiments, stocks and products based on sugar and fats.

We claim:

1. A sprinkler for dispensing powdered and granular products comprising:

a container body having walls and a top defining an open end for containing powdered and granular products;

a closure which surmounts and has a first portion which is fastened to the container body about the top open end of the container body and which extends from the top open end of the container body to a second closure portion which has surfaces displaced from and above and in a plane parallel with a plane defined by the top open end of the container body and which has holes therethrough for dispensing the products; and a plate which surmounts the top open end of the container body displaced from and below and in a plane parallel with the second closure portion and held firmly in place between the closure and container thereby defining a chamber between the plate and closure, the plate having openings abutted by flanges which protrude into the container body for providing distribution of powdered and granular products from the container body into the chamber to the closure for avoiding blocking of the holes of the second closure portion during dispensing of the products from the container body via the openings in the plate and the holes through the second closure portion.

2. A sprinkler according to claim 1 wherein the closure and plate are removable.

3. A sprinkler according to claim 2 wherein the plate openings and abutting flanges leave an area of from 10% to 20% intact at the center of the plate.

4. A sprinkler according to claim 1 wherein the plate is integral with the closure.

5. A sprinkler according to claim 4 wherein the plate openings and abutting flanges leave an area of from 10% to 20% intact at the center of the plate.

6. A sprinkler according to claim 1 wherein the openings and abutting flanges are uniformly distributed in the form of a rosette.

7. A sprinkler according to claim 6 wherein the plate openings and abutting flanges leave an area of from 10% to 20% intact at the center of the plate.

8. A sprinkler according to claim 1 wherein the openings and abutting flanges are configured substantially in a shape selected from the group consisting of a trapezoidal, triangular, semicircular and semielliptical shape.

9. A sprinkler according to claim 8 wherein the plate openings and abutting flanges leave an area of from 10% to 20% intact at the center of the plate.

10. A sprinkler according to claim 1 wherein the plate is removable.

11. A sprinkler according to claim 1 wherein the closure is removable.

12. A sprinkler according to claim 1 wherein the plate openings and abutting flanges leave an area of from 10% to 20% intact at the center of the plate.

13. A sprinkler according to claim 1 wherein the powdered and granular products are comprised of fats.

* * * * *